US006870940B2

(12) United States Patent
Meyer et al.

(10) Patent No.: US 6,870,940 B2
(45) Date of Patent: Mar. 22, 2005

(54) METHOD OF OPERATING A HEARING AID AND HEARING-AID ARRANGEMENT OR HEARING AID

(75) Inventors: Wolfram Meyer, Möhrendorf (DE); Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 348 days.

(21) Appl. No.: 09/956,232

(22) Filed: Sep. 19, 2001

(65) Prior Publication Data

US 2002/0044669 A1 Apr. 18, 2002

(30) Foreign Application Priority Data

Sep. 29, 2000 (DE) ..... 100 48 341

(51) Int. Cl.[7] ..... H04R 25/00

(52) U.S. Cl. ..... 381/314; 381/23.1; 381/315; 381/320; 381/321

(58) Field of Search ..... 381/23.1, 312, 381/314, 325, 320, 321, 323, 60; 73/585; 600/559

(56) References Cited

U.S. PATENT DOCUMENTS

| | | | | |
|---|---|---|---|---|
| 5,202,927 A | | 4/1993 | Tøpholm | |
| 5,604,812 A | * | 2/1997 | Meyer | 381/314 |
| 5,706,351 A | | 1/1998 | Weinfurtner | |
| 6,240,192 B1 | * | 5/2001 | Brennan et al. | 381/314 |

FOREIGN PATENT DOCUMENTS

| | | |
|---|---|---|
| EP | 0 064 042 | 11/1982 |
| EP | 0 788 290 | 8/1997 |
| WO | WO 99/65275 | 12/1999 |

* cited by examiner

*Primary Examiner*—Curtis Kuntz
*Assistant Examiner*—Tuan D. Nguyen
(74) *Attorney, Agent, or Firm*—Schiff Hardin LLP

(57) ABSTRACT

For the automatic choice of a hearing program, a hearing aid (1) detects whether it is located in the immediate vicinity of an external transmitter (10, 10'). The transmitter (10, 10') generates a transmitter-specific signal so that an assignment of different transmitters can be made. In addition, in the case of the hearing aid (1), the current time of day and the day of the week can also influence the choice of the active hearing program.

18 Claims, 2 Drawing Sheets

METHOD OF OPERATING A HEARING AID AND HEARING-AID ARRANGEMENT OR HEARING AID

BACKGROUND OF THE INVENTION

1. Field of the Invention

The invention relates to a method of operating a hearing aid and to a hearing-aid arrangement or a hearing aid with a receiving unit and a signal processing unit, which can be automatically adapted to different hearing situations.

2. Description of the Related Art

European patent document EP 0 064 042 B1 discloses a hearing aid with a microphone, a signal processing unit and an earphone, in which different sets of parameters can be stored in a memory for adapting the signal processing unit to different hearing situations. As a result, the hearing aid is equipped with different hearing programs for different hearing situations, which can be switched between manually.

A disadvantage of the known hearing aid is that, when the hearing situation changes, the person wearing the hearing aid has to set the hearing aid manually to the new hearing situation. For this purpose, it is necessary to know how the individual hearing programs are assigned to the different hearing situations. Furthermore, it is a nuisance to actuate an operating element for setting to the new hearing situation.

U.S. Pat. No. 5,604,812 discloses a hearing aid which, for automatic switching between different hearing programs, has a signal analysis unit which identifies the current hearing situation and selects a suitable hearing program. A disadvantage of this is that the automatic identification of the hearing situation often does not succeed and, as a result, the hearing aid is operated in a wrong hearing program.

The automatic analysis of the hearing situation presents problems particularly if features of different hearing situations are present simultaneously. Such hearing situations may be, for example, a car journey in which a piece of music is being played on the car radio, as well as a conversation during a car journey. In these examples, it may happen that the hearing aid does not correctly identify the "car" hearing situation or frequently switches back and forth between the hearing programs for "car journey" and "music" or "conversation".

SUMMARY OF THE INVENTION

The object of the invention is to provide a method of operating a hearing aid and a hearing-aid arrangement or hearing aid in which the automatic adaptation to different hearing situations is more effective. This object is achieved for the method of operating a hearing-aid, the hearing-aid arrangement, and the hearing aid described below.

To avoid errors in the identification of a current hearing situation, the invention provides external transmitters, which are installed in preferred places where the person wearing the hearing aid goes. This could be, for example, the car, the living room, or the workplace of the person wearing the hearing aid. Once a transmitter has been activated, each transmitter automatically emits a transmitter-specific signal, which allows the hearing aid to make a definite assignment of the signal to a hearing situation in which the transmitter is located. The signal strength of the signal emanating from the transmitter should be adjusted in this case such that the signal can be received only in the immediate vicinity of the transmitter. The hearing aid consequently detects whether it is located in the immediate vicinity of a transmitter and in the immediate vicinity of which transmitter it is located.

Consequently, by the installation of a number of different transmitters in different, preferred places where the person wearing the hearing aid goes, the signal processing unit of a hearing aid according to the invention can be adapted automatically to different hearing situations without having to carry out an error-prone signal analysis of the microphone signals or having to operate the hearing aid manually to do this.

The assignment of the individual transmitters to different hearing situations may be performed by programming the hearing aid, for example, using a PC or remote control. If signals of a number of transmitters are received simultaneously by the hearing aid, the signal strength of the incoming signals can be used as a criterion for ascertaining which hearing program is set. The hearing program assigned to the strongest signal is then advantageously chosen.

An external transmitter operated in connection with the invention may permanently emit a signal in the switched-on state, and the receiving unit of the hearing aid may also be permanently "active" for receiving the signal of an external transmitter. Parameters of the signal processing unit for the adaptation to a hearing situation which can be identified by the transmitter are then automatically set and retained in a storage area as long as the signal emanating from the external transmitter is continuously received. To save energy, which is advantageous in particular in battery operation, the signal emission of the transmitter may, however, also only take place at periodic time intervals and with a short time duration in each case.

In a way similar to the transmitter, energy can also be saved in the hearing aid by the receiving unit only being switched to "active" at periodic time intervals and only for short time periods in each case. If periodic operation is envisioned both for the transmitter and for the receiving unit, the time periods in which the transmitter and the receiving unit are active are correspondingly synchronized. As long as the hearing aid receives the signal of the external transmitter at periodic time intervals, parameters of the signal processing unit are set according to the hearing situation assigned to the transmitter. This transmitter no longer has any influence on the signal processing only when the signal processing unit no longer receives the signal of the external transmitter for one (or optionally more) transmitting or receiving period (s).

One embodiment of the invention provides that parameters of the signal processing unit are only set in accordance with an external transmitter from which a signal emanates if the signal strength of the signal received in the hearing aid exceeds a threshold value; preferably this threshold value is flexibly configurable via hardware or software and possibly by using a transmitted signal or a manually or automatically adjustable input mechanism. This permits fixing relatively exactly the range of the transmitter that the latter will have influence on the signal processing of the hearing aid.

Furthermore, in a further embodiment, two threshold values can be set. The signal processing is influenced if the signal strength goes above a first, higher threshold value and the signal processing unit is not influenced if the signal strength goes below the second, lower threshold value. If the signal strength lies between the two threshold values, the settings of the signal processing unit at the time are retained. The hysteresis formed in this way with respect to the signal strength prevents frequent switching over of the signal processing in the immediate vicinity of a transmitter. For different transmitters, the setting of different pairs of threshold values, assigned to the individual transmitters is possible.

Another possibility for setting the distance from a transmitter within which the transmitter has influence on the signal processing unit of the hearing aid is provided by setting the transmitting power directly at the transmitter. This can be used particularly if transmitters characterizing different hearing situations are installed relatively close to one another.

The transmitter-specific signal is generally emitted permanently or periodically from the transmitters used in connection with the present invention. However, individual transmitters may also be advantageously switched on and off together with certain items of equipment or machines. The transmitters are only in operation and only have influence on the signal processing of the hearing aid when the associated item of equipment or associated machine is switched on. For example, the "car journey" hearing program is only active if the person wearing the hearing aid is in his car and at the same time the engine is switched on, or the "television" hearing program is active in particular when the person wearing the hearing aid is in front of the switched-on television set, or the "work" hearing program is always active when the person wearing the hearing aid is in the immediate vicinity of a specific, switched-on machine.

In the case of a hearing aid according to the invention, the automatic choice of the active hearing program in the immediate vicinity of an external transmitter preferably is primarily made by this transmitter and, if no such signal can be received in the hearing aid, by a conventional analysis of the microphone signals or by manual choice of the hearing program.

One embodiment of the invention provides that the current time is used as a parameter to improve the automatic choice of the active hearing program. Apart from the current time of day, this may also comprise the day of the week and day in the year. For example, in the case of a hearing aid according to the invention, the "office" hearing program may be active with preference on a weekday which is not a public holiday from 8 a.m. to 5 p.m.

Preferred hearing programs for specific time periods can be selected by programming the hearing aid, for example, using a PC or remote control. This "time control" is advantageously assigned its own hearing program so that if time periods are programmed and the corresponding hearing program is set manually by the person wearing the hearing aid, the choice of the active hearing program is preferably determined on the basis of the current time.

For determining the current time, the hearing aid according to the invention may have an internal clock. It may, however, be designed for receiving the time signal of an external transmitter, for example, the radio clock signal "DCF 77". Furthermore, the assignment of specific hearing situations to different time periods may also take place in an external device outside the hearing aid, for example, in a remote control unit. The comparison with the current time of day then also takes place in this external device and a signal characterizing the current hearing situation is merely transmitted from this device to the hearing aid for the automatic setting of parameters of the signal processing unit of the hearing aid.

The invention can be used in the case of all types of hearing aids, such as hearing aids which can be worn behind the ear (BTE), hearing aids which can be worn in the ear (ITE), hearing-aid spectacles, pocket devices, implantable hearing aids, etc. Hearing systems comprising more than one hearing aid are also considered.

DESCRIPTION OF THE DRAWINGS

Details of the invention are explained in more detail below with reference to an exemplary embodiment and the drawings.

DETAILED DESCRIPTION OF THE INVENTION

Figure 1:
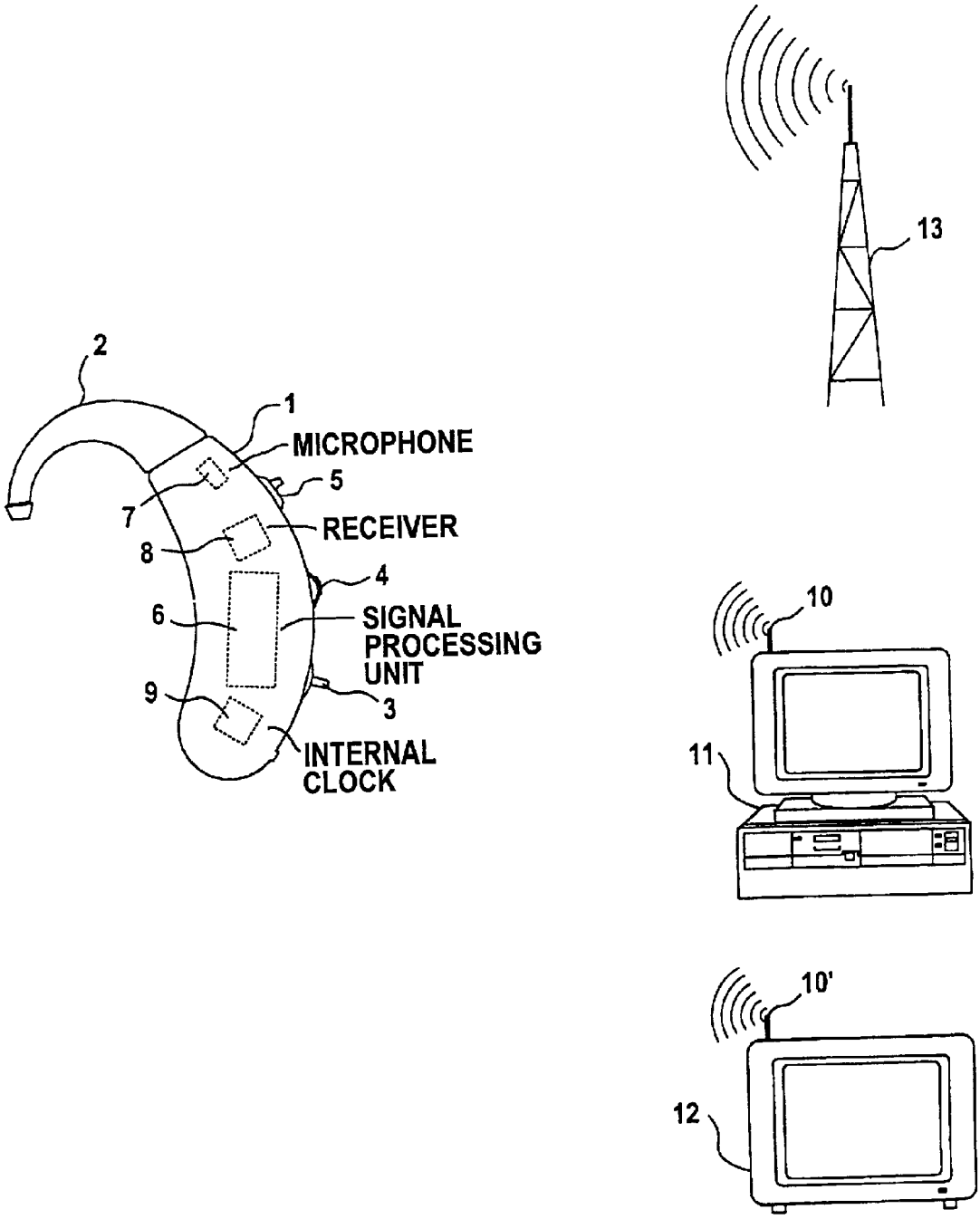
FIG. 1 is a pictoral block diagram showing a hearing aid which can be worn behind the ear, an external transmitter in connection with a television set, an external transmitter in connection with a personal computer (PC) and a time signal transmitter.

The hearing aid 1 which can be worn behind the ear, according to FIG. 1, comprises a supporting hook 2, an MTO switch 3 for switching off the hearing aid (O) and for choosing signal recording via the microphone (M) or a telephone coil (T), a volume adjuster 4 and a program selection button 5. Furthermore, for signal processing, the hearing aid 1 has the signal processing unit 6. For adapting the hearing aid 1 to different hearing situations, different sets of parameters of the signal processing unit 6 can be activated. For automatically choosing a hearing program and consequently a set of parameters for the signal processing unit 6, the output signal of the microphone 7 is analyzed. In order to improve the automatic identification of the current hearing situation, the hearing aid 1 also has a receiver 8. This is designed for receiving the signals emanating from the external transmitters 10, 10', 13. In this case, a time signal emanates from the transmitter 13 and a transmitter-specific signal respectively emanates from the transmitters 10 and 10'. If the signal level of the signal emanating from the transmitter 10 or 10' reaches a certain signal strength at the receiver 8, the hearing aid 1 detects that it is located in the immediate vicinity of the transmitter and, since the signals are transmitter-specific, in the immediate vicinity of which transmitter it is located at that particular time.

By programming the hearing aid, for example, using a PC or remote control, a definite assignment between the transmitter-specific signals, and consequently the different transmitters (and the hearing situations associated with them) is stored in the hearing aid. If the signal of a transmitter is then received in the hearing aid 1, then the hearing aid identifies the current hearing situation from this signal and, expediently, automatically sets parameters of the signal processing unit 6.

In the exemplary embodiment, the transmitter 10 is connected to a PC 11 at the workplace of the person wearing the hearing aid. The hearing aid 1 detects through the transmitter 10 and the receiver 8 that the person wearing the hearing aid is at his workplace at that time and activates the "office" hearing program. A further transmitter 10' is installed on the television set 12 of the person wearing the hearing aid and is coupled to its on/off switch. When the television set 12 is switched on, the transmitter 10' is also active and the hearing aid 1 automatically switches to the "television" hearing program when it is in the immediate vicinity of the switched-on television set 12.

The hearing aid 1 is additionally equipped with an internal clock 9. It has a calendar function and influences the automatic selection of the active hearing program. Programming the clock can fix on which days and at which times of day specific hearing programs are set with preference. For example, on work days between 8 a.m. and 5 p.m., the "office" hearing program may preferably be activated. For exact and convenient setting of the current time of day, the hearing aid is preferably designed for receiving an external time signal (for example DCF 77) of a time-signal transmitter 13. This dispenses with manual setting of the time of day, for example, for changing over between summer time and winter time.

The selection of specific time periods and days of the week and the assignment to specific hearing programs which are to be chosen with preference for the selected times preferably takes place by programming the hearing aid using a PC or remote control. The program selection button 5 allows the hearing aid 1 according to the invention to be brought into the "automatic timing" hearing program intended for the time control, in which the setting of parameters of the signal processing unit takes place automatically under the influence of the internal clock 9.

Figure 2:
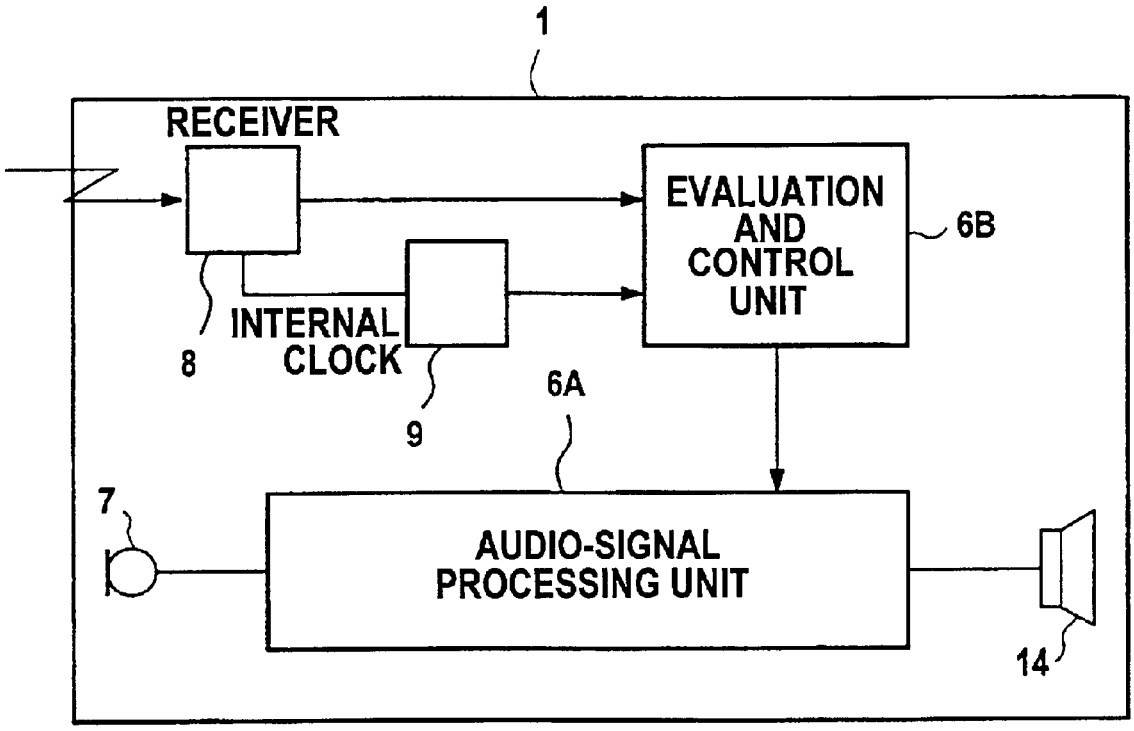
FIG. 2 is a block diagram of a hearing aid according to the invention.

FIG. 2 shows the block diagram of the hearing aid 1 according to FIG. 1. The audio-signal path of the hearing aid 1 has a microphone 7, an audio-signal processing unit 6A and an earphone 14. For the wireless reception of signals of external transmitters, the hearing aid 1 also comprises the receiving unit 8. Coming into consideration here as external transmitters are the transmitters 10 and 10' for characterizing the hearing situation according to the invention, the time-signal transmitter 13, remote control units, programming devices, etc. If the signal received is a time signal, it is used for setting the internal clock 9.

All the other signals received are fed to the evaluation and control unit 6B. In the case of the signal of a transmitter 10 or 10' characterizing the hearing situation, the evaluation and control unit 6B carries out a comparison of the signal strength with two programmable threshold values. If both threshold values are exceeded, the evaluation and control unit 6B detects the vicinity of the hearing aid 1 from a transmitter 10 or 10', and consequently identifies the hearing situation, and finally carries out an automatic adaptation of parameters of the audio-signal processing unit 6A in view of this hearing situation. If the signal strength goes below both threshold values, the transmitter does not bring about any adaptation of parameters of the audio-signal processing unit 6A. Adaptations previously brought about by the transmitter are rescinded. If the signal strength lies between the two threshold values, the parameters of the audio-signal processing unit 6A at that time under the influence of the transmitter are retained in a storage area.

Furthermore, during the programming of the hearing aid 1, hearing programs may be assigned to specific times of day and days of the week. The data required for this are stored in the evaluation and control unit 6B. A comparison of the stored data with the time signal of the internal clock 9 then likewise leads to an automatic adaptation of parameters of the audio-signal processing unit 6A if a specific hearing program is provided for the time of day at that time and the hearing aid is in the "automatic timing" hearing program.

For convenient adaptation of the internal clock 9 to the current time (time of day, day of the week, year), the hearing aid is designed for receiving the signal (e.g., DCF 77) of an external time-signal transmitter 13. The signal is received by the receiving unit 8 and corrects the time of day of the internal clock 9 at regular time intervals.

The above-described method of operating a hearing aid and hearing aid apparatus are illustrative of the principles of the present invention. Numerous modifications and adaptations will be readily apparent to those skilled in this art without departing from the spirit and scope of the present invention.

What is claimed is:

1. A method of operating a hearing aid, comprising the steps of:

providing said hearing aid with a receiving unit and a signal-processing unit that can be automatically adapted to different hearing situations;

substantially continuously emitting an inaudible signal from an external transmitter in an area that is at least occasionally occupied by a person wearing said hearing aid;

receiving said emitted inaudible signal in an immediate vicinity of said external transmitter by said hearing aid at said area;

assigning a stored signal characteristic in said hearing aid to a hearing situation at said area; and automatically setting parameters of said signal processing unit for adaptation to said hearing situation if said received signal has a characteristic matching said stored signal characteristic.

2. The method of operating a hearing aid as claimed in claim 1, further comprising the step of retaining said set parameters as long as said emitted signal is received.

3. The method of operating a hearing aid as claimed in claim 1, further comprising the steps of:

providing at least one additional external transmitter at a further area exhibiting a hearing situation, thus creating a plurality of external transmitters;

emitting a transmitter-specific inaudible signal from each of said plurality of transmitters;

for each further area, assigning a stored signal characteristic in said hearing aid to the hearing situation at that further area;

receiving one of said emitted transmitter-specific inaudible signals from one of said plurality of transmitters;

automatically setting parameters of said signal-processing unit for adaptation to the hearing situation of the area assigned to a signal characteristic that matches said one of said transmitter-specific signals is received.

4. The method of operating a hearing aid as claimed in claim 1, further comprising the step of retaining said parameters of said signal processing unit as long as said emitted signal from said external transmitter is received at periodic time intervals.

5. The method of operating a hearing aid as claimed in claim 1, further comprising the step of emitting a signal by said external transmitter at periodic time intervals.

6. The method of operating a hearing aid as claimed in claim 1, further comprising the steps of:

determining a signal strength of said received signal in said hearing aid;

comparing said determined signal strength with a threshold value;

automatically setting and retaining parameters of said signal processing unit for adaptation to said hearing situation assigned as long as said signal strength exceeds said threshold value.

7. The method of operating a hearing aid as claimed in claim 1, further comprising the steps of:

determining a signal strength of said received signal in said hearing aid;

comparing said determined signal strength with a first threshold value;

comparing said determined signal strength with a second threshold value, wherein said second threshold value is lower than said first threshold value;

automatically setting said parameters of said signal processing unit if said determined signal strength exceeds said first threshold value; and retaining said parameters of said signal processing unit until said determined signal strength is less than said second threshold value.

8. A hearing-aid arrangement, comprising:

an external transmitter that substantially continuously emits an inaudible signal in an area exhibiting a hearing situation; and a hearing aid, comprising:

an audio-signal processing unit settable with different parameters for adaptation to different hearing situations;

a receiving unit for receiving said emitted inaudible signal;

an evaluation and control unit configured to detect if said receiving unit receives said emitted inaudible signal and configured to automatically set said parameters of said audio-signal processing unit for adapting audio signal processing unit to said hearing situation based solely on detection of reception of said emitted inaudible signal.

9. The hearing-aid arrangement as claimed in claim 8, further comprising a storage area in which said parameters are retained for as long as said receiving unit receives said emitted signal.

10. The hearing-aid arrangement as claimed in claim 8, wherein said receiving unit is configured to received said emitted signal at periodic time intervals.

11. The hearing-aid arrangement as claimed in claim 8, wherein said external transmitter is configured to emit a signal at periodic time intervals.

12. The hearing-aid arrangement as claimed in claim 8 wherein said evaluation and control unit is configured to sense a signal strength of said emitted signal, compare said signal strength with a first threshold value, and maintain said audio-signal processing unit set with said parameters for said hearing situation for as long as said sensed signal strength exceeds said first threshold value.

13. The hearing-aid arrangement as claimed in claim 12 wherein said evaluation and control unit allows varying of said threshold value.

14. The hearing-aid arrangement as claimed in claim 12, wherein said evaluation and control unit compares said emitted signal with said first threshold value and with a second threshold value, said second threshold value being lower than said first threshold value, and wherein said evaluation and control unit is configured to set said parameters of said audio-signal processing unit for said hearing situation if the signal strength sensed by said evaluation and control unit exceeds said first threshold value and to maintain said audio-signal processing unit set with said parameters for said hearing situation for as long as said signal strength sensed by the evaluation and control unit does not go below said second threshold value.

15. The hearing-aid arrangement as claimed in claim 14 at least one of said first and second threshold values.

16. A hearing aid comprising:

a signal processing unit settable with parameters adapt to different hearing situations;

an internal clock that tracks the current time;

a storage area that stores specific time ranges with specific hearing situations assigned to said specific time ranges; and an evaluation and control unit that compares said current time with said stored specific time ranges and automatically sets said parameters of said signal processing unit for the specific hearing situation assigned to the time range in which said current time falls.

17. A hearing aid comprising:

a signal processing unit settable with parameters adapt to different hearing situations;

said hearing aid being configured to automatically set parameters of said signal processing unit accordance with the current time; and a remote control unit, comprising:

an internal clock that tracks the current time;

a storage area for storing specific time periods and specific hearing situations assigned to said remote control specific time periods; and an evaluation and control unit in which said remote control current time is compared with said remote control stored specific time periods, a signal being transmitted from said remote control unit to a non-remote part of said hearing aid for automatically setting said parameters of said signal processing unit based on said remote control comparison.

18. The hearing aid arrangement as claimed in claim 8, further comprising:

at least one additional external transmitter, thus creating a plurality of external transmitters each emitting a transmitter-specific signal, each transmitter in said plurality of transmitters being in a respective further area exhibiting a hearing situation;

said receiving unit receiving one of said transmitter-specific signals from one of said plurality of transmitters; and said evaluation and control unit, for each further area, assigning a stored signal characteristic to the hearing situation at that further area, and automatically setting said parameters of said signal processing unit for adaptation to the hearing situation of the area assigned to a signal characteristic that matches said one of said transmitter-specific signals that is received.

* * * * *